US008667894B2

(12) United States Patent
Nissen

(10) Patent No.: US 8,667,894 B2
(45) Date of Patent: Mar. 11, 2014

(54) PILING AND COMPRESSING PIECES OF COMPRESSIBLE MATERIAL

(75) Inventor: Per Nissen, Esbjerg (DK)

(73) Assignee: Seelen A/S, Esbjerg (DK)

( * ) Notice: Subject to any disclaimer, the term of this patent is extended or adjusted under 35 U.S.C. 154(b) by 0 days.

(21) Appl. No.: 13/817,457

(22) PCT Filed: Aug. 26, 2011

(86) PCT No.: PCT/EP2011/064736

§ 371 (c)(1),
(2), (4) Date: Feb. 18, 2013

(87) PCT Pub. No.: WO2012/028553

PCT Pub. Date: Mar. 8, 2012

(65) Prior Publication Data

US 2013/0145939 A1 Jun. 13, 2013

(30) Foreign Application Priority Data

Aug. 30, 2010 (EP) ..... 10008974

(51) Int. Cl.
*B30B 13/00* (2006.01)
*B30B 9/00* (2006.01)
*B30B 15/06* (2006.01)

(52) U.S. Cl.
CPC ..... *B30B 9/00* (2013.01); *B30B 15/062* (2013.01)
USPC ..... 100/35; 100/266; 100/245; 100/295

(58) Field of Classification Search
USPC ..... 100/3, 35, 295, 296, 297, 215, 226, 100/245; 53/523, 526, 527, 528, 529, 540
See application file for complete search history.

(56) References Cited

U.S. PATENT DOCUMENTS 3,908,539 A * 9/1975 O'Brien ..... 100/49
4,372,201 A * 2/1983 Dudziak et al. ..... 100/7

(Continued)

FOREIGN PATENT DOCUMENTS

CA 952495 A1 8/1974
DE 102005001130 A1 8/2005

OTHER PUBLICATIONS

Extended European Search Report. Application No./Patent No. 10008974.7-2308. European Patent Office. Munich, Germany. Date of completion of the search: Feb. 17, 2011.

(Continued)

*Primary Examiner* — Jimmy T Nguyen
(74) *Attorney, Agent, or Firm* — Mollborn Patents, Inc.; Fredrik Mollborn

(57) ABSTRACT

System and methods for piling and compressing pieces of insulation wool. The system includes a piling tower for receiving and piling multiple pieces of insulation wool and compression plates for compressing multiple pieces of insulation wool. The system includes a first and a second compression plate having plane and smooth upper and lower surfaces, whereby the compression plate can be slid out from between two compressed pieces of insulation wool. The compression plates receive a batch between the compression plates and compress the batch by moving one compression plate towards the other. The pressure on the insulation wool does not need to be relieved after the pieces have been compressed once as the system and method makes it possible to gradually increase compression toward the bottom of the piling tower by shifting between the first and second compression plate being used for compressing a batch of pieces of insulation wool.

10 Claims, 6 Drawing Sheets

(56) References Cited

U.S. PATENT DOCUMENTS

| | | | | |
|---|---|---|---|---|
| 4,408,438 | A * | 10/1983 | Rewitzer | 53/438 |
| 4,738,078 | A * | 4/1988 | Benz et al. | 53/439 |
| 4,953,344 | A | 9/1990 | Wallace | |
| 5,311,724 | A | 5/1994 | Vernon et al. | |
| 6,397,738 | B1 * | 6/2002 | Brown, Jr. | 100/3 |

OTHER PUBLICATIONS

PCT InternationalPreliminary Report on Patentability International application No. PCT/EP2011/064736. European Patent Office. Munich, Germany. Date of completion of this report : Nov. 29, 2012.

* cited by examiner

PILING AND COMPRESSING PIECES OF COMPRESSIBLE MATERIAL

FIELD OF THE INVENTION

The present invention relates to a method of piling and compressing pieces of compressible material, such as pieces of insulation wool. Further, the invention relates to a system for piling and compressing pieces of compressible material, such as insulation wool.

BACKGROUND OF THE INVENTION

Insulation wool is being used for insulating e.g. houses in order to reduce energy loss. Insulation wool is a material comprising a lot of air and in order to save space both when transporting and storing it is an advantage to compress the material before packaging. This is of course not only an advantage when it comes to insulation wool, but also other material comprising air, such as foam e.g. used in furniture, e.g. in mattresses, could be compressed to save space.

It is known to stack and compress compressible products, such as insulation wool, in the same process. When a lot of wool pieces are to be stacked before being compressed and packed, a quite high tower is needed in order to stabilize and fixate the pieces before and during compressing; this problem limits the number of wool pieces which can be stacked. A limitation of prior art is that the height of the piling tower limits the number of insulation wool pieces that can be stacked in one batch of piled pieces.

U.S. Pat. No. 4,953,344 describes a method of compressing glass fibre insulation batts or pieces and this is done using compression plates having a concave surface. The concave surface ensures that the batts can be compressed in a higher degree without damaging the batts. In this method the height of the apparatus limits how many batts a stack can consist of.

U.S. Pat. No. 3,908,539 describes an apparatus for stacking and compressing pieces or batts of compressible material and after a compression plate has compressed batts of compressible material the batts are pushed laterally out of the stacking chamber and into a bagging machine. In this method the height of the apparatus limits how many batts a stack can consist of.

CA 952 495 describes a machine for stacking flexible material, where two stacking plates are in turns stacking material into batches. Plates define sidewalls of the machine ensuring that the material is aligned, and further an opening is provided at the bottom allowing a stacking plate to slide out between batches and be moved upwards for starting compression of further material into batches. A problem with this machine is, that because of the predefined position of the opening where a plate can slide out, limitations are introduced as to how much a specific material can be compressed and as to in which dimensions batches can be made.

OBJECT AND SUMMARY OF THE INVENTION

The object of the invention is to solve the above-mentioned problems.

In accordance with various embodiments of the invention, a continuously packing is possible where pieces of compressible material can be added while the first and second compression plate cycle and compress the compressible material. The number of pieces that can be compressed is not limited by the height of the piling tower, since the pieces can be compressed during piling by cycling between compression from respectively the first and the second compression plate.

Further, by ensuring a continuous flow of piling and compressing by shifting between compression from respectively the first and the second compression plate, the pressure on the pieces of insulation wool is never relieved after the pieces have been compressed once. The compression is gradually increased toward the bottom of the tower without the pressure at any time being relieved again. Thereby the risk of damaging the compressible material is significantly removed, which is especially relevant when it comes to specific types of insulation wool.

The flexible sidewalls being used for delimiting sides of the piling tower ensure that the compression plates always have access to the compressible material when being moved up and down the piling tower. Thereby the system can be used for continuous packing where any batch size and compression rate is possible, thereby making it possible to adapt the machine to different kinds of material of the compressible pieces and to different requirements to the batch size.

BRIEF DESCRIPTION OF THE DRAWINGS

In the following, preferred embodiments of the invention will be described referring to the figures, where.

DESCRIPTION OF EMBODIMENTS

Figure 1:
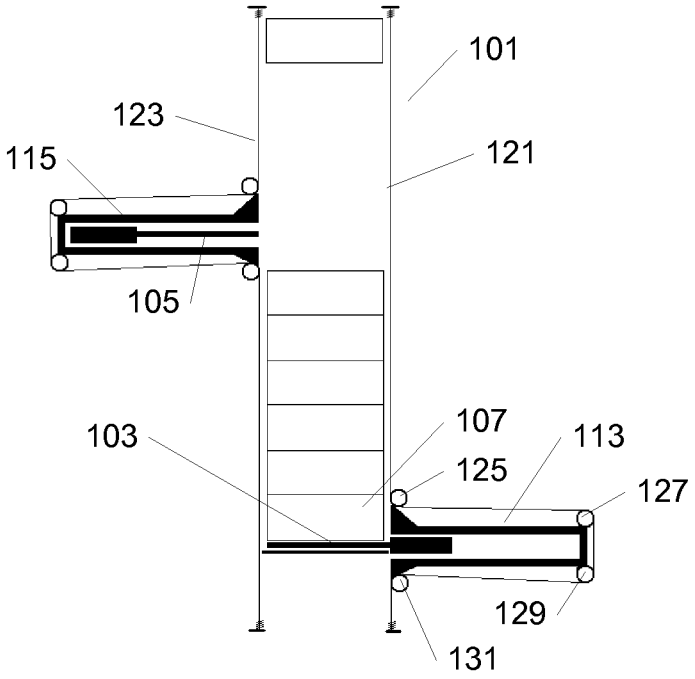
FIG. 1 illustrates the basic elements of a system according to the present invention.

The basic elements of a system according to the present invention are illustrated in FIG. 1. The system comprises a piling tower 101 for piling pieces of insulation wool 107. The pieces of insulation wool enter the piling tower at the top. The system further comprises a first and a second compression plate 103 and 105, these plates are being used for compressing batches of piled pieces of insulation wool, wherein a batch comprises multiple pieces of insulation wool. After being piled and compressed the batches leave the piling tower 101 at the bottom. After leaving the piling tower further processing of the batches can be performed such as packaging e.g. by wrapping in foil. The compression plates are positioned in sliding drawers 113, 115, whereby the compression plate 103 and 105 can slide into the piling tower 101 and out from the sliding drawer 113, 115 or out from the piling tower 101 and into the sliding drawer 113, 115. The compression plate 103 and 105 has a plane and smooth upper and lower surface, whereby the plate can be slid out when supporting at least one batch of compressed insulation wool, without or at least with a minimum of damages on the surface of the piece of insulation wool having contact with the compression plate. In the embodiment illustrated in the figures, flexible sidewalls embodied as belts 121, 123 have been added; the belts delimit the sides of the piling tower and thereby assist aligning piled pieces of insulation wool. The belts further extend around the sliding drawers 113 via sliding members or belt rollers 125, 127, 129, 131. This is also the case with regards to the other sliding drawer 115. Thereby the sliding drawers can be moved upwards and downwards parallel to the piling tower while the compression plates 103, 105 maintain access to the piles in the piling tower. The sidewalls are flexible in the sense that the compression plates are able to access the pile of compressible material at any position.

The method of stacking is described in the following using FIGS. 1-6.

The piling is started when the piling tower 101 is empty, the first compression plate 103 is positioned at the top of the piling tower 101 and pieces of insulation wool enter the piling tower 101 and falls down on the first compression plate 103. The pieces enter the piling tower and the first compression plate 103 moves downwards enabling space for more pieces, while ensuring that the falling distance between the upper piece of insulation wool and the new entering piece is minimised. This is minimised to avoid large falling speed which could result in damage of the insulation wool and further result in a more precise aligning of the insulation wool pieces.

In FIG. 1 the first compression plate has reached the bottom of the piling tower and a number of pieces of insulation wool has entered and is piled on the first compression plate 103. The second compression plate 105 is positioned in the sliding drawer 115 enabling both pieces of insulation wool and the first compression plate 103 to pass the second compression plate 105.

Figure 2:
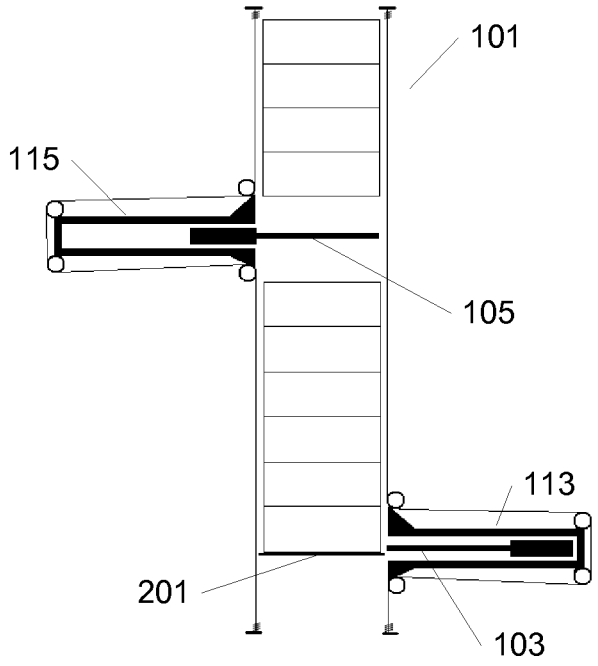
FIGS. 2-6 illustrate the method of stacking and compressing according to the present invention.

As illustrated in FIG. 2, when a predefined number of insulation wool pieces has been piled, whereby a batch of multiple piled pieces of insulation material has been obtained on said first compression plate 103, the second compression plate 105 is slid out of the sliding drawer 115 and into the piling tower 101, whereby the second compression plate 105 is positioned in the sliding tower 101 above the piled batch of multiple pieces of insulation material. Further, the first compression plate 103 is slid out from below the batch of multiple pieces of insulation material into the sliding drawer 113, whereby the bottom surface 201 of the piling tower carries the batch.

Pieces of insulation material now enter the piling tower and the second compression plate moves downwards enabling space for more pieces while ensuring that the falling distance between the upper piece of insulation wool and the new entering piece is minimised.

Figure 3:
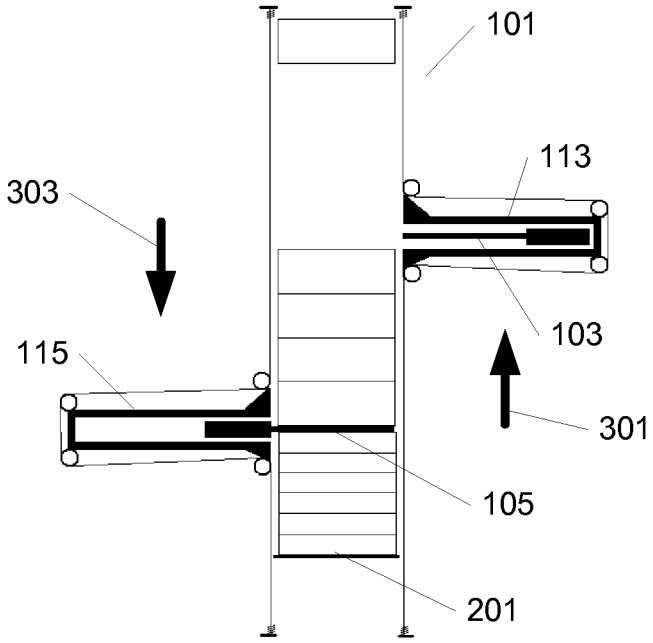

FIG. 3 illustrates the sliding drawer 115 where the second compression plate 105 is positioned above the piled batch of multiple pieces of insulation material and moved downwards 303 while receiving new pieces of insulation wool on top of the compression plate 105, while compressing the batch of piled insulation material between the second compression plate 105 and the bottom surface 201 of the piling tower 101. Further, as illustrated in FIG. 3 the first compression plate 103 has been moved upwards 301 to the top of the piling tower 101.

Figure 4:
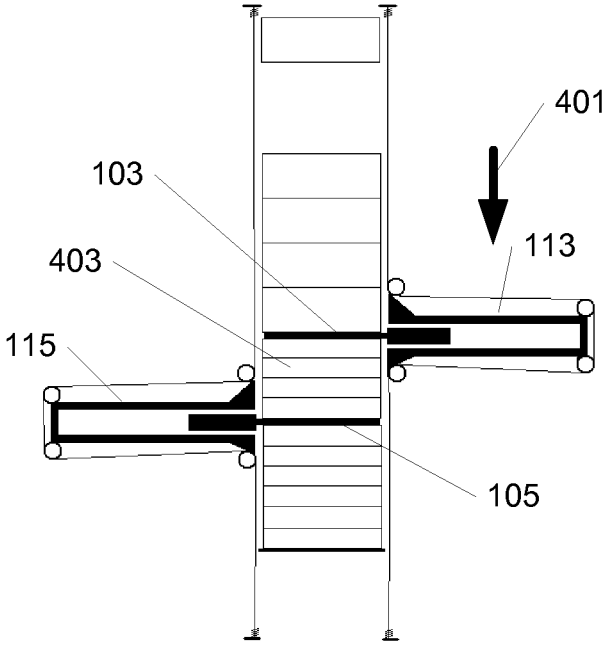

In FIG. 4 the first compression plate 103 has entered the piling tower and a number of pieces of insulation wool is piled on the second compression plate 105 while the first compression plate 103 is moved downwards 401 compressing the piled batch 403.

Figure 5:
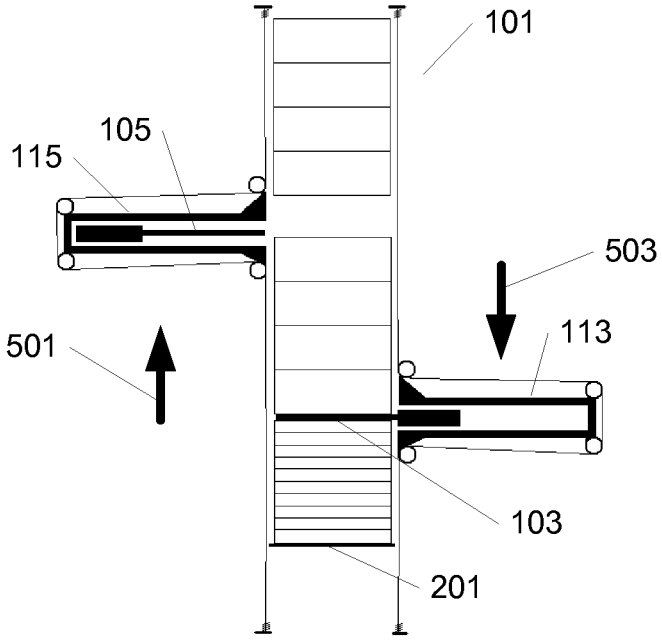

As illustrated in FIG. 5, a predefined number of insulation wool pieces has been piled on said first compression plate, the second compression plate 105 has been slid into the sliding drawer 115 and the compression plate is moved upwards 501. Further, the first compression plate 103 is moved downwards 503 for further compressing the piled pieces.

Figure 6:
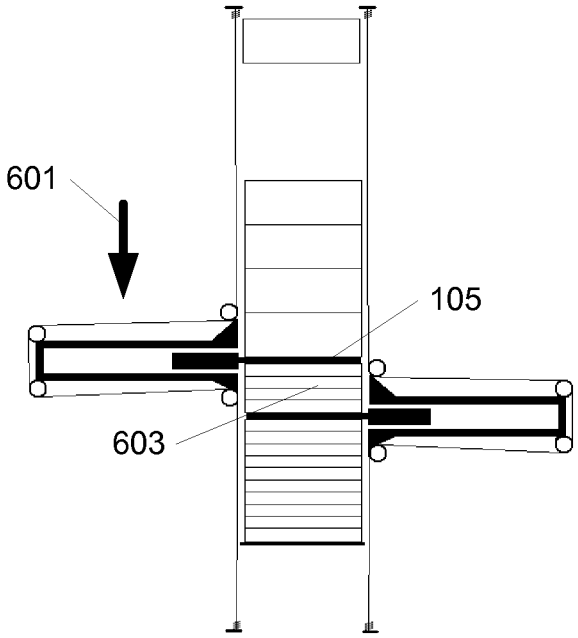

In FIG. 6 the second compression plate 105 has entered the piling tower and a number of pieces of insulation wool are piled on the second compression plate 105 while the second compression plate 105 is moved downwards 601 compressing the piled batch 603.

The above cycle continues, whereby the two compression plates interchange between being at the top and at the bottom during the compression cycle. The cycle repeats until the wanted number of pieces of insulation wool is compressed inside the tower and the stack is being held compressed by one of the compression plates at the top of the piled pieces. The multiple piled and compressed pieces of insulation wool can then be pushed or pulled out of the tower and further processed.

Figure 7:
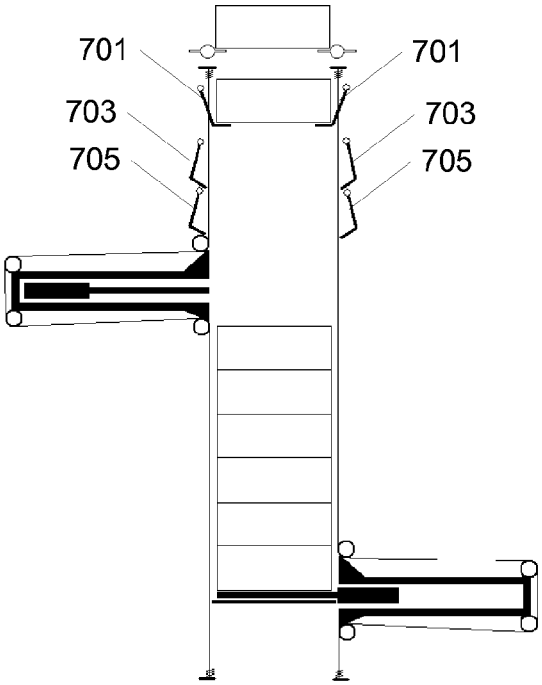
FIG. 7 illustrates holding arms positioned at the top of the piling tower.

FIG. 7 illustrates an embodiment where sets of holding arms 701, 703, 705 are mounted at the top of the piling tower. The holding arms can be tilted between a first position where they can hold a piece of insulation wool and a second position where they can drop a piece of insulation wool previously being held by the arms. The purpose of these arms is to both ensure that new pieces of insulation wool are ready to be transferred to a compression plate, but also to minimize the falling distance of the pieces. In the illustrated embodiment three sets of holding arms have been mounted enabling the pieces to be stepwise released downwards to a compression plate.

The timing of the stacking cycle including movement of the compression plates and the holding arms can be controlled by a programmed computer. Further, timing of the different steps can be determined based on sensors, such as optical sensors.

Figure 8A:
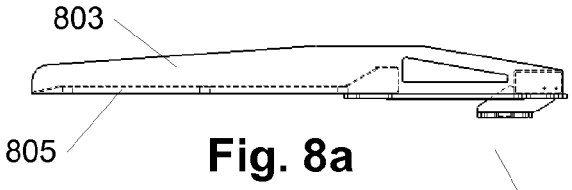
FIGS. 8*a* and 8*b* illustrate an embodiment of a compression plate.
Figure 8B:
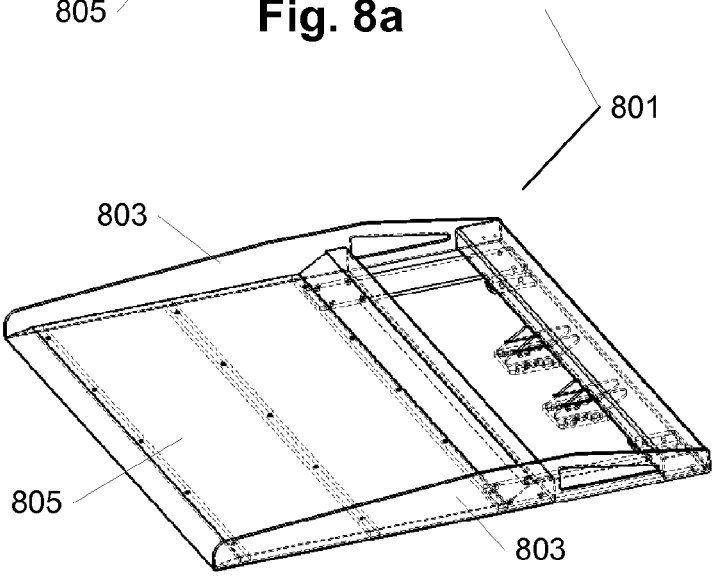

FIGS. 8*a* and 8*b* illustrate an embodiment of a compression plate seen from the side in FIG. 8*a* and from an isometric view in FIG. 8*b*, respectively. The plate is wedge shaped and has a super smooth surface e.g. obtained by using a smooth plate and adding sliding varnish to the surface of the plate.

The front of the compression plate 801 comprises sidepieces 803 mounted on each side of a sliding plate 805. In the illustrated embodiment the sliding plate is made from three pieces of thin metal which have been welded together and processed to obtain a smooth surface. Further, the sidepieces 803 are higher than the thickness of the sliding plate 805 and are also made from a thicker metal than the sliding plate. The sidepieces 803 and the sliding plate 805 being assembled by three pieces ensure strength of the compression plate The examples given are based on insulation material, but the apparatus could be used for piling and compressing other types of compressible material such as foam products, e.g. mattresses.

Figure 9:
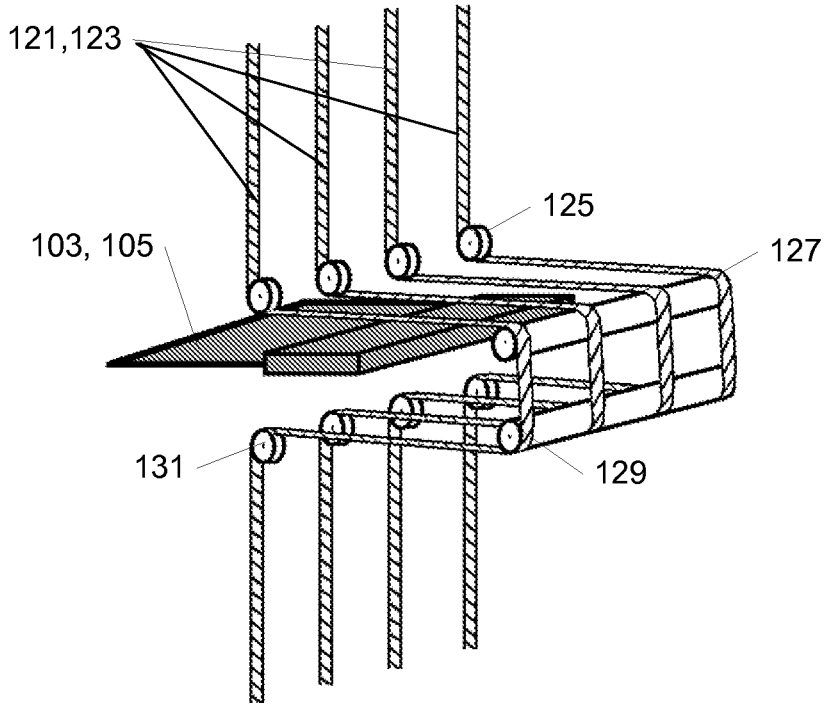
FIGS. 9,10 and 11 illustrate alternative embodiments of the flexible sidewalls.
Figure 10:
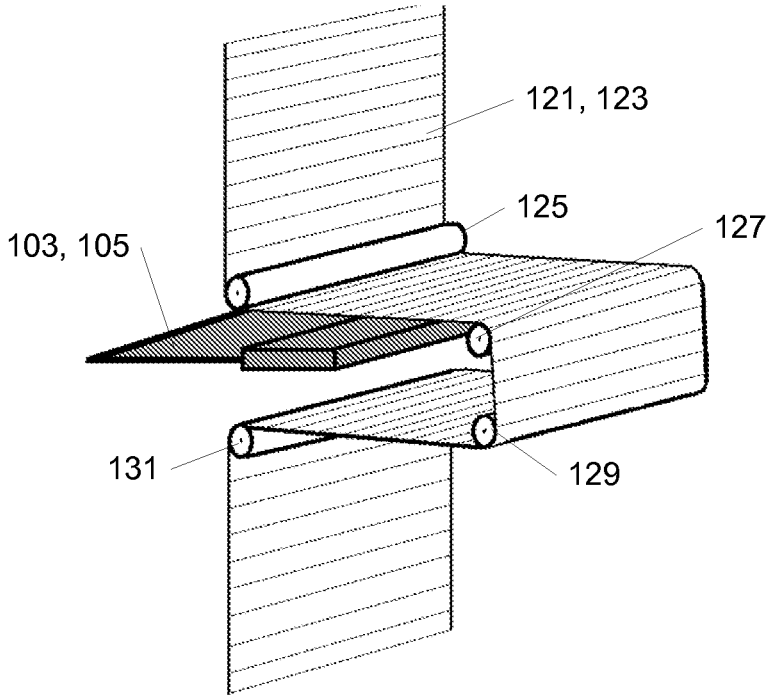

FIGS. 9 and 10 illustrate embodiments of the belts which are one way of making the sidewalls flexible whereby the compression plates are able to access the compressible material at any position.

In this embodiment belts 121, 123 are extending around belt rollers, also referred to as sliding means 125, 127, 129, 131, and these rollers also constitute the sliding drawer 113, 115. Both figures illustrate a compression plate 103, 105 between the sliding means.

In FIG. 9 an embodiment of the flexible sidewalls is illustrated where a number of narrow belts are used extending around the belt rollers 125, 127, 129 and 131.

In FIG. 10 an embodiment of the flexible sidewalls is illustrated where a single wide belt is used extending around the belt rollers 125, 127, 129 and 131.

In the above example belts are described, but alternatively plastic or metal chains could also be used.

A property of the flexible sidewalls is that the sliding drawer can move op and down while the sidewalls adapt around the sliding drawer 113, 115. Any sidewall allowing that could be used. If belts are used, these belts could e.g. be made from a textile or from plastic material or any other flexible material.

Figure 11:
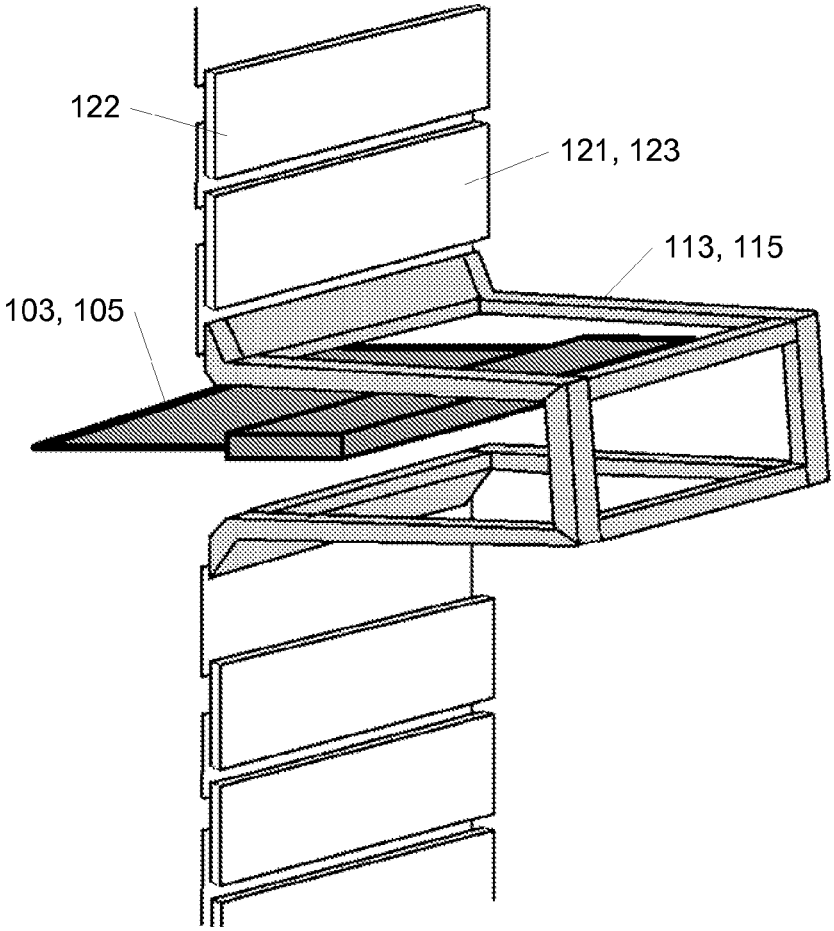

In FIG. 11 an example is given where the sidewalls are made flexible in an alternative way. In this embodiment the side walls are made from a number of stiff plates which can either be made longer or shorter in a telescopic manner, whereby the stiff plates 122 either lie in layers or in continuation of each other. The plates could be made from thin metal or another stiff material. The plates are connected to a sliding drawer 113, 115. Also in this embodiment flexible sidewalls are obtained, whereby the compression plate 103, 105 is able to access the compressible material at any position.

The invention claimed is:

1. A system for piling and compressing pieces of compressible material, wherein said system comprises a piling tower for receiving and piling said pieces in batches comprising a number of piled pieces and means for compressing said batches, wherein the system further comprises:

a first and a second compression plate having a plane and smooth upper and lower surface, whereby the compression plate can be slid out from between two compressed pieces, said first and second compression plate being positioned on different sides of said piling tower whereby respectively said first and said second compression plate can be moved independently along said piling tower, said compression plates being adapted for receiving a batch between said compression plates and compressing said batch by moving one compression plate towards the other, wherein the sides of said piling tower are defined by flexible sidewalls, said flexible sidewalls comprising sliding drawers and said sidewalls extend around said sliding drawers and said sliding drawers being adapted to move upwards and downwards parallel to the piling tower while the compression plates maintain access to the piles in the piling tower.

2. A system according to claim 1, wherein the flexible sidewalls are belts extending around said sliding drawers.

3. A system according to claim 2, wherein said sliding drawers comprise sliding means being belt rollers.

4. A system according to claim 1, wherein said system further comprises at least one set of holding arms mounted at the top of the piling tower.

5. A system according to claim 1, wherein said compression plates are wedge shaped.

6. A system according to claim 1, wherein said compression plates comprise a layer of sliding varnish added to the surface of the plates.

7. A method of piling and compressing pieces of compressible material, in a piling tower, wherein said method comprises receiving said pieces, piling said pieces and compressing said piled pieces, wherein compressing said piled pieces comprises the consecutive steps of:

piling a first batch of multiple pieces on a first compression plate having a plane and smooth upper and lower surface, positioning said second compression plate having a plane and smooth upper and lower surface plate on top of said piled first batch, whereby said piled first batch is positioned between said first compression plate and a second compression plate, moving said second compression plate towards said first compression plate thereby compressing said piled first batch, sliding said first compression plate out from below said piled and compressed first batch, piling a second batch of multiple pieces on said second compression plate, positioning said first compression plate on top of said piled second batch, whereby said piled second batch is positioned between said second and first compression plate, moving said first compression plate towards said second compression plate thereby compressing said piled second batch, sliding said second compression plate out from below said piled and compressed second batch.

8. A method according to claim 7, wherein said consecutive steps are performed continuously until said piling tower comprises a pile of compressed pieces and a predefined number of batches is obtained.

9. A method according to claim 7, wherein said consecutive steps are performed continuously until said piling tower comprises a pile of compressed pieces and a predefined height is obtained.

10. A method according to claim 7, wherein the compression of said pieces of compressible material is gradually increased during said piling and compressing.

* * * * *